US008517371B2

(12) United States Patent
Horade

(10) Patent No.: US 8,517,371 B2
(45) Date of Patent: Aug. 27, 2013

(54) SHEET FEEDING DEVICE WITH SHEET DETECTION UNIT

(75) Inventor: Kenta Horade, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days.

(21) Appl. No.: 13/338,710

(22) Filed: Dec. 28, 2011

(65) Prior Publication Data

US 2012/0161387 A1 Jun. 28, 2012

(30) Foreign Application Priority Data

Dec. 28, 2010 (JP) ..... 2010-293962

(51) Int. Cl.
*B65H 5/00* (2006.01)

(52) U.S. Cl.
USPC ..... 271/10.11; 271/10.03; 271/10.05; 399/396

(58) Field of Classification Search
USPC ..... 271/10.11, 10.02, 10.03, 10.05, 265.01, 271/270; 399/396
See application file for complete search history.

(56) References Cited

U.S. PATENT DOCUMENTS

| | | | | |
|---|---|---|---|---|
| 7,415,239 | B2 * | 8/2008 | Saito et al. | 399/388 |
| 7,621,518 | B2 * | 11/2009 | Iesaki et al. | 271/3.14 |
| 8,205,954 | B2 * | 6/2012 | Terada | 347/16 |
| 2009/0212481 | A1 * | 8/2009 | Takayama | 271/10.11 |
| 2011/0064500 | A1 * | 3/2011 | Takahashi | 399/396 |

FOREIGN PATENT DOCUMENTS

| | | |
|---|---|---|
| JP | 2002-037483 | 2/2002 |
| JP | 2005-335302 A | 12/2005 |

* cited by examiner

*Primary Examiner* — Jeremy R Severson
(74) *Attorney, Agent, or Firm* — Scully, Scott, Murphy & Presser, P.C.

(57) ABSTRACT

A sheet feeding device includes a first roller configured to feed a sheet in a first direction along a first feed path, a second roller arranged on a downstream side of the first roller and configured to feed the sheet in the first direction along the first feed path, a sheet detection unit arranged between the first roller and the second roller. A rotation amount of the second roller from detection of the leading end of the sheet by the sheet detection unit to arrival of the sheet at a predetermined position on the downstream side is compensated based on the rotation speed of the first roller within a first period, which is a period from start of feeding of the sheet as the first roller is started to be driven to the detection of the leading end of the sheet by the sheet detection unit.

14 Claims, 7 Drawing Sheets

| SHEET FEED SPEED (ips) | NORMAL SHEET | | GLOSSY SHEET | |
|---|---|---|---|---|
| | ROTATION AMOUNT | COMPENSATION AMOUNT | ROTATION AMOUNT | COMPENSATION AMOUNT |
| 1 | 6000 | 0 | 6600 | 0 |
| 5 | 6050 | 50 | 6655 | 50 |
| 10 | 6100 | 100 | 6710 | 110 |
| 20 | 6200 | 200 | 6820 | 220 |
| 25 | 6400 | 400 | 7040 | 440 |

FIG. 6

SHEET FEEDING DEVICE WITH SHEET DETECTION UNIT

CROSS-REFERENCE TO RELATED APPLICATION

This application claims priority under 35 U.S.C. §119 from Japanese Patent Application No. 2010-293962 filed on Dec. 28, 2010. The entire subject matter of the application is incorporated herein by reference.

BACKGROUND

1. Technical Field

Aspects of the invention relate to a sheet feeding device configured to feed a sheet along a sheet feed path in a predetermined direction (i.e., a sheet feed direction).

2. Related Art

There has been known an image formation device in which a printing sheet is firstly fed by a pick-up roller, and then further fed by a pair of sheet feed rollers to a print start position without performing a sheet registration process.

Since the conventional image formation device as described above does not perform the sheet registration process, the printing sheet fed by the sheet feed rollers should be fed to and stopped at a predetermined target position (e.g., the print start position). Since the registration is not performed, in order to located the printing sheet at the target position, control and configuration as indicated below may be employed.

A sheet sensor to detect the leading end of the printing sheet is provided between the pick-up roller and the pair of feed rollers. When the sensor detects the leading end of the sheet, which is being fed from the pick-up roller to the feed rollers, a rotation amount of the feed rollers is counted. When the rotation amount of the feed rollers reaches a predetermined set amount, which has been preliminarily determined based on a distance between the sheet sensor and the print start position, rotation of the feed rollers is stopped and the sheet is stopped. With this control, the printing sheet can be located at the print start position without performing the sheet registration process.

SUMMARY

In the above configuration, the sheet is fed, by the pick-up roller, from the pick-up roller to the feed rollers, while, on the downstream side with respect to the feed rollers, the sheet is fed by the feed rollers. Therefore, the sheet is fed by the pick-up roller within a zone between the sensor to the feed rollers.

If the pick-up roller and the feed rollers are driven by different motors, a problem as follows may occur. That is, if there is an error in rotation speeds of the pick-up roller and/or the feed rollers, a timing when the sheet is nipped by the pair of feed rollers may be different from a designed timing. Regardless of the nipped timing, the feed rollers are controlled to stop when they are driven to rotate by the predetermined rotation amount after the leading end of the sheet is detected by the sensor. With this configuration, the position where the sheet is stopped may different from the print start position due to the variation of the nipped timing.

In consideration of the above problems, aspects of the invention provide an improved sheet feeding device with which a printing sheet can be stopped at a predetermined target position even if there are errors in rotation speeds of the pick-up roller and/or sheet feed rollers, which feed the sheet.

According to aspects of the invention, there is provided a sheet feeding device, which includes a first roller configured to feed a sheet in a first direction along a first feed path, a first motor configured to drive the first roller to rotate, a second roller arranged on a downstream side, in the first direction, of the first roller and configured to feed the sheet in the first direction along the first feed path, a second motor configured to drive the second roller to rotate, a sheet detection unit arranged, in the first feed path, between the first roller and the second roller, and configured to detect a leading end of the sheet fed in the first direction, a speed detection unit configured to detect a rotation speed of the first motor and a rotation speed of the second motor, a judging unit configured to judge whether the rotation speeds of the first motor and the second motor detected by the speed detection unit are equal to target rotation speeds of the first motor and the second motor, respectively, and a first compensation unit configured to set a second rotation amount by compensating a first rotation amount that is set preliminarily as a rotation amount of the second roller for feeding the sheet, from detection of the leading end of the sheet by the sheet detection unit, to a predetermined position on the downstream side, in the first direction, of the second roller, based on the rotation speed of the first roller within a first period, which is a period from start of feeding of the sheet as the first roller is started to be driven to the detection of the leading end of the sheet by the sheet detection unit, on condition that the leading end of the sheet is detected by the sheet detection unit, if the judging unit judges that at least one of (a) the rotation speed of the first motor detected by the speed detection unit is not equal to the target rotation speed of the first motor and (b) the rotation speed of the second motor detected by the speed detection unit is not equal to the target rotation speed of the second motor.

According to aspects of the invention, there is also provided a sheet feeding device, which includes a first roller configured to feed a sheet in a first direction along a first feed path, a first motor configured to drive the first roller to rotate, a second roller arranged on a downstream side, in the first direction, of the first roller and configured to feed the sheet in the first direction along the first feed path, a second motor configured to drive the second roller to rotate, a sheet detection unit arranged, in the first feed path, between the first roller and the second roller, and configured to detect a leading end of the sheet fed in the first direction, a speed detection unit configured to detect a rotation speed of the first motor and a rotation speed of the second motor, a judging unit configured to judge whether a ratio of the rotation speed of the first motor to the rotation speed the second motor is equal to a ratio of a target speed of the first motor to a target speed of the second motor, a compensation unit configured to compensate at least one of the rotation speed of the first motor and the rotation speed of the second motor so that the ratio of the rotation speed of the first motor to the rotation speed of the second motor coincides with the ratio of a target speed of the first motor to a target speed of the second motor based on the ratio of the rotation speed of the first motor to the rotation speed the second motor within a first period from start of feeding of the sheet as the first roller is started to be driven to the detection of the leading end of the sheet by the sheet detection unit on condition that the leading end of the sheet is detected by the sheet detection unit, if the judging unit judges that the ratio of the rotation speed of the first motor to the rotation speed of the second motor does not coincide with the ratio of the target speed of the first motor to the target speed of the second motor, and a control unit which controls the second roller to rotate by a first rotation amount which is preliminarily set as a rotation amount of the second roller for feeding the sheet, from detection of the leading end of the sheet by the detection unit, to a predetermined position on the downstream side, in the first direction, of the second roller, on condition that the leading end of the sheet is detected by the sheet detection unit.

BRIEF DESCRIPTION OF THE ACCOMPANYING DRAWINGS

FIG. 6 schematically shows a structure of a data table.

Figure 7:
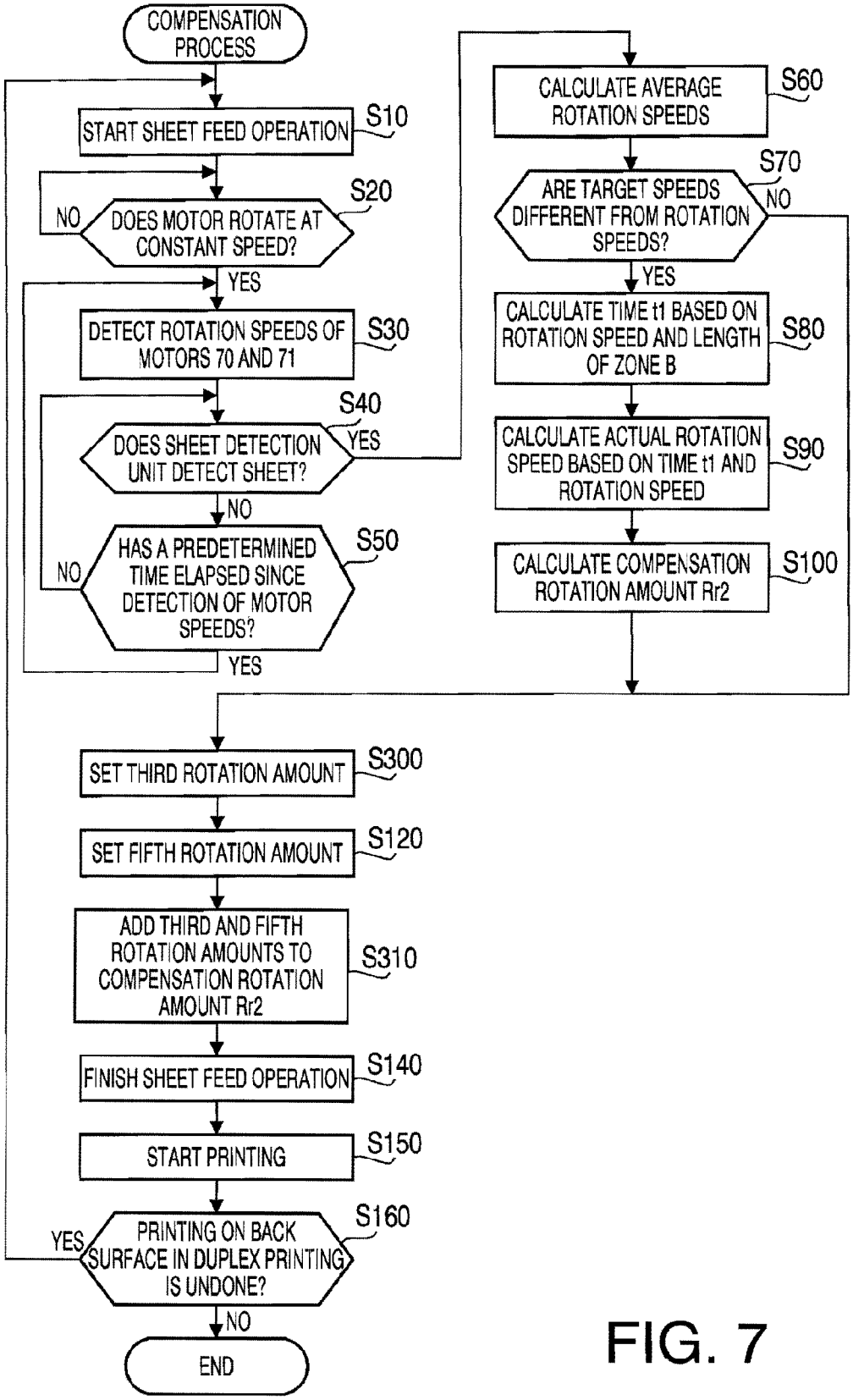

FIG. 7 is a flowchart illustrating a compensation process according to a second modification of the embodiment of the invention.

DETAILED DESCRIPTION

Figure 1:
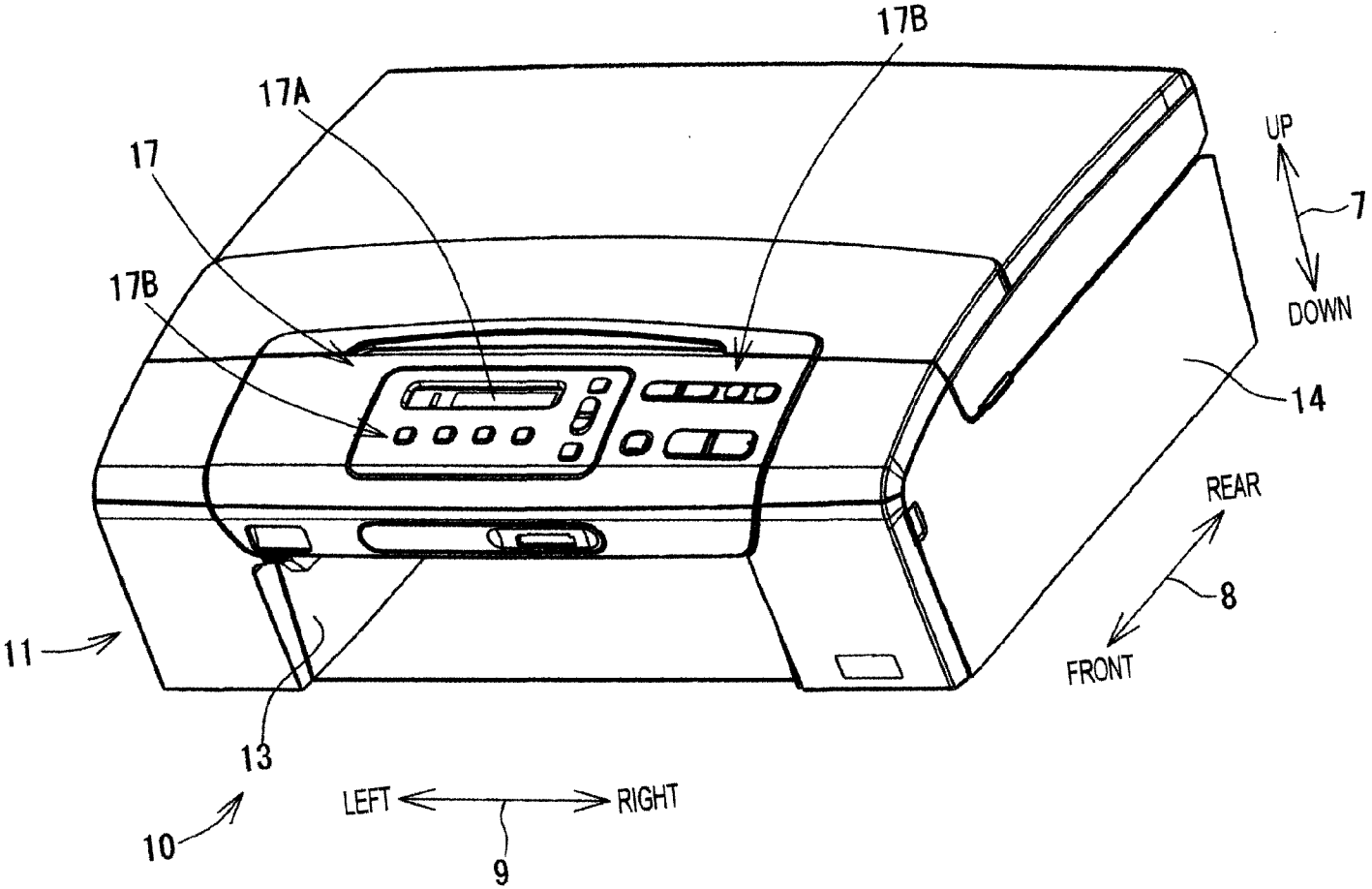
FIG. 1 is a perspective view of an MFP (multi-function peripheral) according to an embodiment of the invention.

Hereinafter, an MFP (multi-function peripheral) 10 according to an exemplary embodiment of the invention and its modifications will be described with reference to the accompanying drawings. In the following description, an up and down directions 7 are defined based on a state where the MFP 10 is placed for use, as shown in FIG. 1. Front and rear directions of the MFP 10 are defined such that an opening 13 is formed on a front side of the MFP 10. Right and left directions are defined such that a right-hand direction when the MFP 10 is viewed from the front side will be referred to the right direction, and a left-hand direction will be referred to as the left direction.

It should be noted that the embodiment and its modifications described hereafter are exemplary ones and can be modified in various ways without departing the scope of the invention.

As shown in FIG. 1, the MFP 10, to which a sheet feeding device is employed, has an outer appearance of a substantially thin rectangular parallelepiped. The MFP 10 has various functions such as a facsimile function, a printing function, and the like. The MFP 10 has a printer section 11, which is an inkjet printing unit, on a lower portion thereof According to the embodiment, the printer section 11 has a duplex printing function. Alternatively, the printing unit 11 may have a simplex printing function.

The printer section 11 has a casing 14 which is formed with the opening 13 on the front side thereof. A sheet tray 20 (see FIG. 2) which is configured to accommodate various sizes of printing sheets can be inserted/removed via the opening 13.

On an upper front surface of the MFP 10, an operation panel 17 is provided. Through the operation panel, a user can input various commands for operating the MFP 10. Specifically, the operation panel 17 has an LCD (liquid crystal display) 17A and a plurality of operation switches 17B.

The user of the MFP 10 may operate (e.g., depress) the operation switches 17B in accordance with messages which are displayed on the LCD 17A to indicate status of the MFP 10 and/or operational instructions. It is noted that the LCD 17A may be provided with a touch panel. In such a case, a part of or all of the operation switches 17B may be replaced with the touch panel and a display of portions to be touched.

Figure 2:
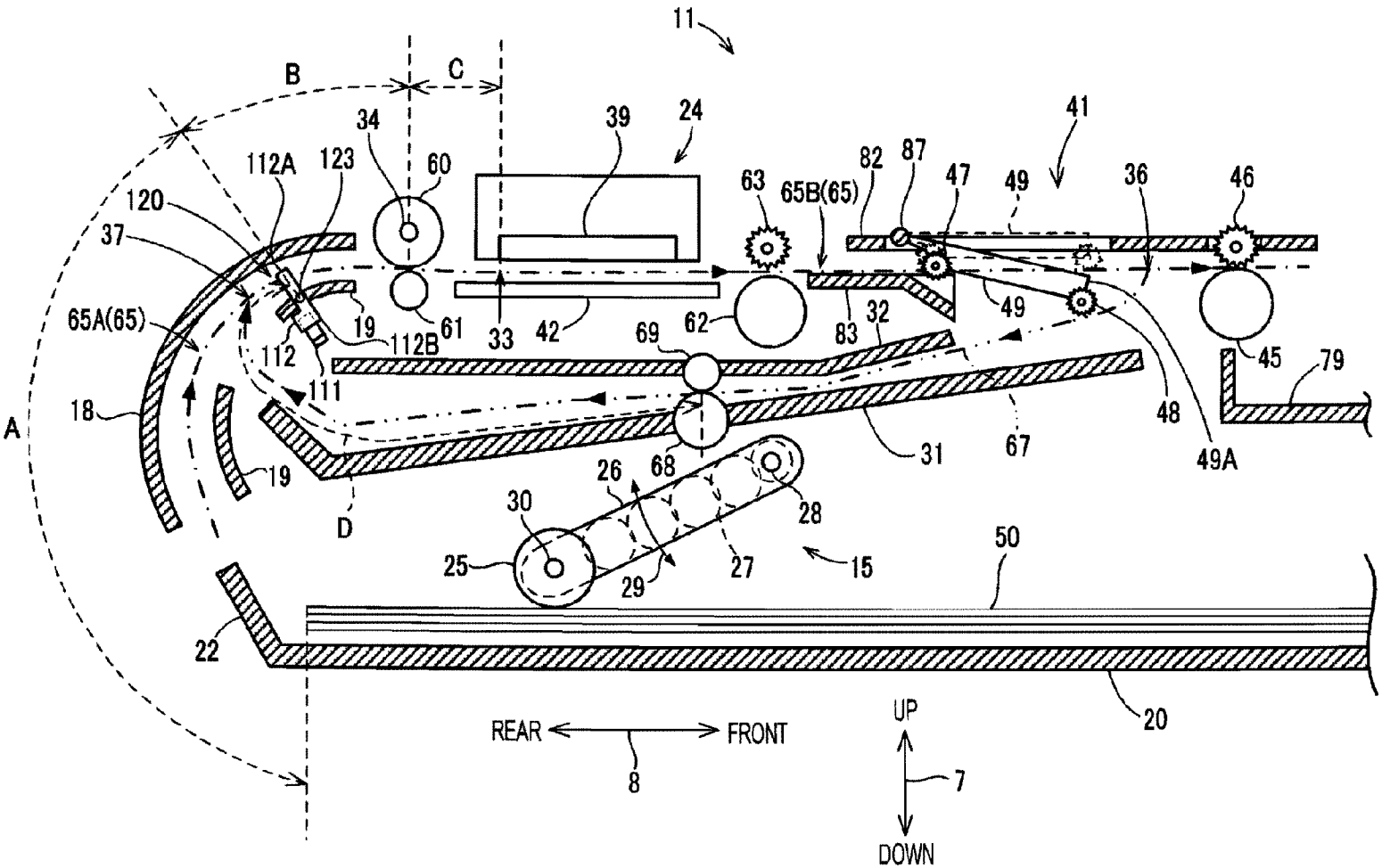
FIG. 2 is a cross-sectional partial side view schematically showing an inner structure of a part of a printer unit of the MFP shown in FIG. 1.

As shown in FIG. 2, the printer section 11 has a sheet feed unit 15 which picks up the printing sheets from the tray 20, and a printing unit 24 which prints images on the printing sheets fed by the sheet feed unit 15 in accordance with the inkjet printing method. It is noted that the printing unit 24 need not be limited to one employing the inkjet printing method, but may be one employing electrophotographic method or the like.

The MFP 10 is provided with a sheet feed device, which is provided with at least a pick-up roller 25, a pick-up motor 70, a first feed roller 60, a feed motor 71, a sheet detector 120 and a control unit 130. The sheet feed device may be provided with a first rotary encoder 72 and a second rotary encoder 73 in addition to the above configuration. Further, the sheet feed device may be provided with an inverse feed path 67 and a fourth feed roller 68.

As shown in FIG. 2, the sheet feed unit 15 is provided on an upper side of the tray 20 and below the printing unit 24. The sheet feed unit 15 is provided with the pick-up roller 25, a pick-up arm 26 and a drive force transmitting mechanism 27. The pick-up roller 25 is rotatably supported at a distal end of the pick-up arm 26. The pick-up arm 26 is configured to rotate (swing) in a direction of arrow 29 about a shaft 28 provided to a proximal end portion of the pick-up arm 26. With this configuration, the pick-up roller 25 can contact the printing sheet accommodated in tray 20 or spaced from the tray 20.

The pick-up roller 25 rotates as the rotational force of the pick-up motor 70 is transmitted, via the driving force transmitting mechanism 27 having a plurality of engaging gears, to the pick-up roller 25. As the pick-up roller 25 rotates when it contacts the uppermost one of the stacked printing sheets in the tray 20, the uppermost printing sheet is separated from the other sheets and fed to a curved path 65A, which will be described below.

Inside the printer section 11, as shown in FIG. 2, a sheet feed path 65, which extends from the rear-side end of the tray 20 to an ejected sheet holding unit 79 via a printing unit 24, is defined. The sheet feed path 65 includes a curved path 65A, which is defined from the end of the tray 20 to the first feed roller 60, and an ejection path 65B, which is defined between the first feed roller 60 to the ejected sheet holding unit 79.

The curved path 65A extends from a position which is in the vicinity of the upper end of a sheet separation plate 22 provided to the tray 20 to the printing unit 24. The curved path 65A is, when view from the side, a circular arc having its center on the inner side of the printer section 11. The printing sheet, which is picked up, by the pick-up roller 25, from the tray 20, is fed along the curved path 65A in a direction indicated by an arrow connected to a dotted line (which will be referred to as a first feeding direction) in FIG. 2, and is directed to a position where the printing sheet is nipped by the first feed roller 60 and a pinch roller 61 (which will be referred to as a nip position).

The curved path 65A is defined by an outer guide member 18 and inner guide members 19, which are spaced from each other by a predetermined distance. It should be noted that the outer guide member 18 and the inner guide members 19 extend in a direction perpendicular to a plane of FIG. 2 (i.e., right and left direction indicated in FIG. 1). Further, guide members 31, 32, 82 and 83, which will be described later, also extend in a direction perpendicular to the plane of FIG. 2.

The ejection path 65B is a linear path extending from the nip position to the ejected sheet holding unit 79. The printing sheet is guided along the ejection path 65B in the first feeding direction. At a portion where the printing unit 24 is provided, the ejection path 65B is partitioned by the printing unit 24 and a platen 42, which are spaced from each other by a predetermined distance. Further, on a downstream side with respect to the printing unit 24, the ejection path 65B is partitioned by an upper guide member 82 and a lower guide member 83, which face each other and are spaced by a predetermined distance.

On the downstream side, in the first feeding direction, of the printing unit 24, and on the downstream side, in the first feeding direction, of a second feed roller 62, a diverging position 36 is defined. The printing sheet fed along the ejection path 65B is switched back (i.e., the feeding direction is reversed) on the downstream side of the diverging position 36 and fed toward a reversed feed path 67 when a duplex printing is performed.

The printing unit 24 is arranged above the tray 20 as shown in FIG. 2. The printing unit 24 reciprocally moves in the right and left direction 9 (i.e., in a direction perpendicular to the plane of FIG. 2). Below the printing unit 24, a platen 42 which holds a printing sheet horizontally is provided. When the printing sheet reaches a predetermined position 33, below the printing unit 24, the printing unit 24 starts moving reciprocally. During the reciprocal movement, the printing unit 24 ejects ink, which is supplied from an ink cartridge (not shown) through nozzles on the printing sheet fed on the platen 42. It should be noted that the predetermined position 33 is defined such that a position at which the leading end of the printing sheet is located when the printing unit 24 starts printing an image on the printing sheet. For example, the predetermined position 33 is defined as an upstream side end, in the first feeding direction, of an area of the sheet ejection path 65B facing an area of the printing unit 24 where the nozzles 39 area arranged.

The first feed roller 60 and the pinch roller 61 are arranged between the printing unit 24 and the outer and inner guide members 18 and 19, as shown in FIG. 2. The pinch roller 61 is arranged below the first feed roller 60, and is urged toward the first feed roller 60 by an elastic urging member such as a spring. The printing sheet fed, by the pick-up roller 25, along the curved path 65A is nipped by the first feed roller 60 and the pinch roller 61, which are arranged on the downstream side, in the first feed direction, with respect to the pick-up roller 25. The sheet nipped by the first feed roller 60 and the pinch roller 61 is fed toward the ejection path 65B as the first feed roller 60 is driven to rotate. Accordingly, the printing sheet is fed and located on the platen 42.

The second feed roller 62 and a spur (corrugated roller) 63 are arranged between the printing unit 24 and the upper and lower guide members 82 and 83, as shown in FIG. 2. The corrugated roller 63 is arranged above the second feed roller 62 and urged toward the second feed roller 62 by an elastic urging member such as a spring. The second feed roller 62 and the corrugated roller 63 hold the printing sheet, on which an image is formed by the printing unit 24, therebetween and feed the printing sheet toward the downstream side in the first feeding direction.

The first and second feed rollers 60 and 62 are rotated as the driving force of the feed motor 71 is transmitted through the driving force transmitting mechanism, which may be a well-known mechanism using, for example, a planetary gear and the like. It is noted that the driving force transmission mechanism according to the embodiment is configured such that, regardless whether the feed motor 71 is forwardly rotated or reversely rotated, each of the first and second feed rollers 60 and 62 rotates in one direction so that the printing sheet is always fed in the first feed direction.

A third feed roller 45 and a spur (corrugated roller) 46 are arranged on the downstream side, in the first feed direction, of the diverging position 36. The corrugated roller 46 is arranged above the third feed roller 45 and is urged toward the third feed roller 45 by an elastic urging member such as a spring.

The third feed roller 45 is driven to rotate in a forward direction or a reverse direction as the forward or reverse driving force of the feed motor 71 is transmitted by the driving force transmitting mechanism.

Specifically, when the simplex printing is performed, the third feed roller 45 is driven to rotate only in the forward direction. As the third feed roller 45 rotates in the forward direction, the printing sheet nipped by the third feed roller 45 and the corrugated roller 46 is fed toward the downstream side and ejected to the ejected sheet holding unit 79.

When the duplex printing is performed, the rotation direction of the third feed roller 45 is changed from the forward direction to the reverse direction if the trailing end of the printing sheet is held by the nip between the third feed roller 45 and the corrugated roller 46. With this change of the rotation direction, the printing sheet, which was fed in the first feeding direction, is then fed in the opposite direction and directed toward the reverse feed path 67 by a path switching unit 41.

The path switching unit 41 is arranged on the downstream side of the second feed roller 62 and on the upstream side of the diverging position 36 as shown in FIG. 2. The path switching unit 41 includes auxiliary rollers 47 and 48, a flap 48 and a shaft 87.

The shaft 87 extends in a direction perpendicular to the plane of FIG. 2 (i.e., in the right and left direction 9 as indicated in FIG. 1), and secured to a frame of the printer section 11. The flap 49 is rotatably supported by the shaft 87 and extends, from the shaft 87, toward the downstream side, substantially in the first feeding direction. The auxiliary rollers 47 and 48 are rotatably supported by the flap 49. Roller surfaces of the auxiliary rollers 47 and 48 contact an image-bearing surface of the printing sheet, and therefore, formed to be corrugated as the corrugated rollers 63 and 46.

The flap 49 is configured such that an orientation thereof can be changed. Specifically, the flap 49 can be rotated between an ejection position where the flap 49 is located at a higher position than the lower guide member 83 (indicated by dotted line in FIG. 2) and a reverse position where the distal end 49A thereof is located at a lower position than the diverging position 36 (indicated by solid line in FIG. 2). The printing sheet passed through the printing unit 24 is fed toward the downstream side in the first feeding direction when the flap 49 is located at the ejection position, while fed to the reverse feeding path 67 (i.e., switchback feeding).

The flap 49 is neutrally located at the reverse position due to its own weight, and is rotated and lifted up by the printing sheet fed along the ejection path 65B and located at the ejection position. When the trailing end of the printing sheet passes through the auxiliary roller 47, the flap 49 rotates due to its own weight and changes its position from the ejection position to the reverse position. According to the embodiment, the flap 49 is rotated by the printing sheet and the own weight. It may be modified that the flap 49 is driven by an actuator such as a motor.

As shown in FIG. 2, the reverse feed path 67 is diverged from the ejection path 65B at the diverging position 36, extends below the printing unit 24 and above the sheet feed unit 15, and converges with the curved path 65A at a converging position 37 which is on the upstream side, in the first feeding direction, of the printing unit 24.

In the reverse feed path 67, the printing sheet is fed in the second feeding direction, which is a direction from the diverging position 36 to the converging position 37 and indicated by two-dotted arrowed line in FIG. 2. The reverse feed path 67 is partitioned by the second guide member 32 which is located above the reverse feed path 67, and the first guide member 31 which is located below the reverse feed path 67.

A fourth feed roller 68 and a driven roller 69 are provided in the reverse feed path 67 as shown in FIG. 2. The fourth feed roller 68 is arranged below and face the driven roller 69. The fourth feed roller 68 is rotated by a feed motor 70 (see FIG. 3). Specifically, the driving force of the feed motor 70 is transmitted via a driving force transmitting mechanism (not shown) to the fourth feed roller 68. With this configuration, the printing sheet fed into the reverse feed path 67 by the third feed roller 45 is nipped by the fourth feed roller 68 and the driven roller 69, which further feed the printing sheet along the reverse feed path 67 in the second feeding direction. The printing sheet is fed toward the curved path 65B via the converging position 37.

The printer section 11 is provided with a sheet detection unit 120 which is configured to detect the leading end of the printing sheet picked up from the tray 20 and fed along the curved path 65A.

The sheet detection unit 120 is arranged on the downstream side, in the curved path 65A, with respect to the pick-up roller 25 and the converging position 37, and on the upstream side with respect to the first feed roller 60. In other words, the sheet detection unit 120 is located, in the curved path 65A, between the pick-up roller 25 and the first feed roller 60.

The sheet detection unit 120 is provided with a rotary member 112 having detectors 112A and 112B, and a photo sensor 111 (e.g., a photo interrupter) including a light emitting element (e.g., a light emitting diode) and a light receiving element (e.g., a phototransistor) which receives light emitted by the light emitting element. The rotary member 112 is configured to be rotatable about a shaft 123. The detector 112A is projected, from the shaft 123, toward the curved path 65A. When no force is applied to the rotary member 112, the detector 112B interferes with an optical path from the light emitting element to the light receiving element of the photo sensor 111, and shields the light proceeding along the optical path. When the rotary member 112 is rotated as pressed by the leading end of the printing sheet, the detector 112B is moved away from the optical path, and the light emitted by the light emitting element is incident on the light receiving element.

Figure 3:
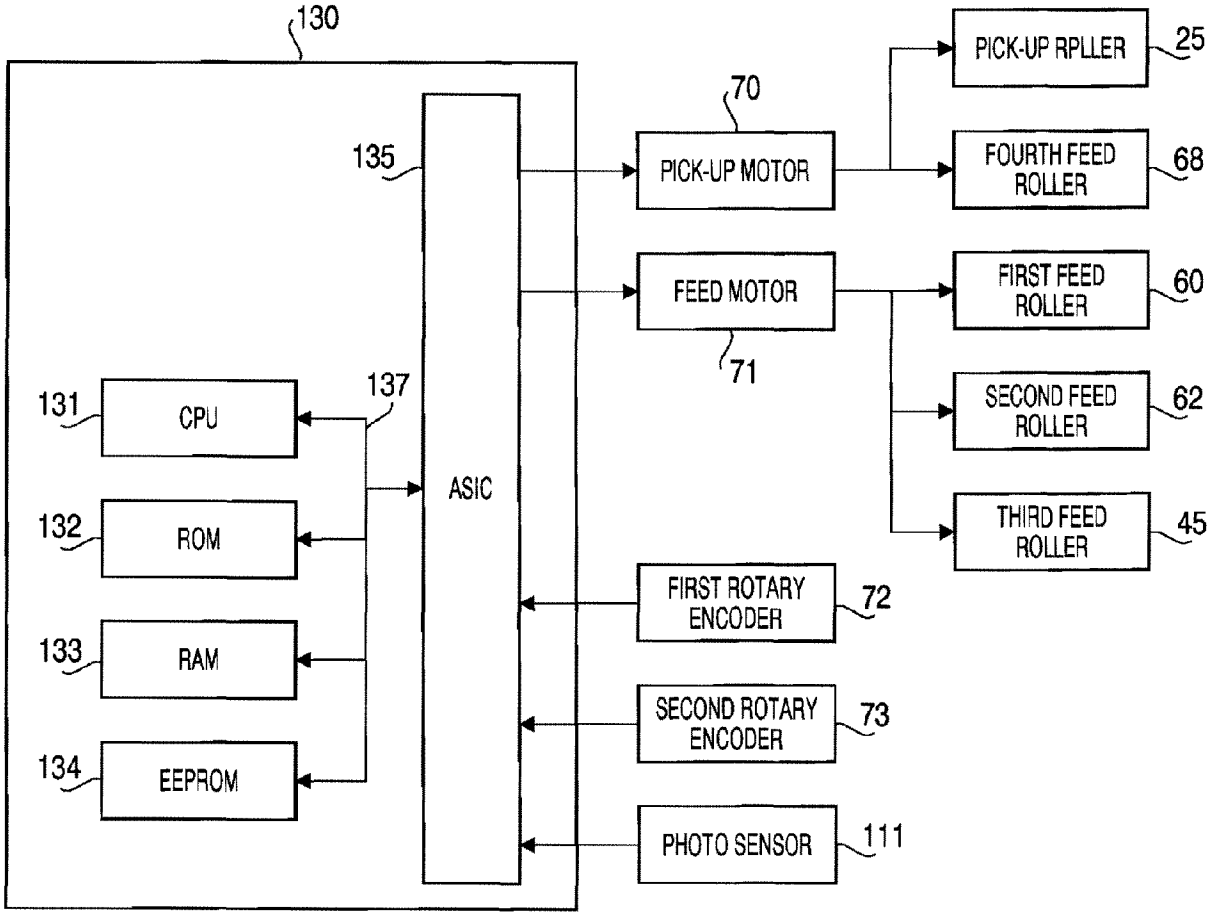
FIG. 3 is a block diagram illustrating a functional configuration of a control unit of the MFP shown in FIG. 1.

As shown in FIG. 3, the MFP 10 is provided with a first rotary encoder 72 and a second rotary encoder 73. The first rotary encoder 72 includes a first encoder disc which is secured to an output shaft of the pick-up motor 70 and rotates integrally therewith, and a first optical sensor. On the first encoder disc, a first pattern having transparent and opaque areas arranged at a predetermined interval (pitch) on a circle, which is concentric with the rotational center of the first encoder disc, is formed. The first optical sensor is arranged to face the first patter formed on the first encoder disc. When the first encoder disc rotates as the output shaft of the pick-up motor 70 rotates, the first optical sensor detects the first pattern (i.e., change of the transparent/opaque areas) and generates a pulse signal. The pulse signal is transmitted from the first optical sensor to a control unit 130. The control unit 130 calculates the rotation amount of the output shaft of the pick-up motor 70 based on the pulse signal generated by the first optical sensor.

Further, the second rotary encoder 73 includes a second encoder disc which is secured to an output shaft of the feed motor 71 and rotates integrally therewith, and a second optical sensor. On the second encoder disc, a second pattern having transparent and opaque areas arranged at a predetermined interval (pitch) on a circle, which is concentric with the rotational center of the second encoder disc, is formed. The second optical sensor is arranged to face the second patter formed on the second encoder disc. When the second encoder disc rotates as the output shaft of the feed motor 71 rotates, the second optical sensor detects the second pattern (i.e., change of the transparent/opaque areas) and generates a pulse signal. The pulse signal generated by the second optical sensor is transmitted to the control unit 130. The control unit 130 calculates the rotation amount of the output shaft of the feed motor 71 based on the pulse signal generated by the second optical sensor.

The control unit 130 is configured to control the entire operation of the MFP 10. As shown in FIG. 3, the control unit 130 includes a micro-computer which is provided with a CPU (central processing unit) 131, a ROM (read only memory) 132, a RAM (random access memory), an EEPROM (electrically erasable programmable ROM) 134 and ASIC (application specific integrated circuit) 135. The above elements are interconnected with an internal bus 137.

The ROM 132 stores programs which cause, when executed, the CPU 131 to control various operations of the MFP 131. The RAM 131 is used as a temporary storage area which temporarily stores various pieces of data and/or signals which are generated when the CPU 131 executes the above programs, or a work area for data processing. The EEPROM 134 stores settings and flags which are to be retained even if the MFP 10 is powered OFF.

The ASIC 135 is connected with the first feed motor 70 and the second feed motor 71. Further, the ASIC 135 is implemented with a drive circuit for driving the pick-up motor 70 and the feed motor 71, a timer (or counter) circuit for measuring an elapsed time, and the like. It should be noted that the timer may be implemented to another unit such as the CPU 131 instead of the ASIC 135.

The control unit 130 controls the pick-up motor 70 and the feed motor 71. When the drive signals causing the motors to start rotating are transmitted from the CPU 131 to drive circuits for driving respective motors, driving currents corresponding to the driving signals are output to respective motors. Then, upon input of the drive current, each motor starts rotating at a predetermined rotation speed in the forward or reverse direction.

The pulse signals output by the first optical sensor of the first rotary encoder 72 and the second optical sensor of the second rotary encoder 73 are input to the ASIC 135. As will be described later, the control unit 130 calculates the rotational speeds of the pick-up motor 70 and the feed roller 71 based on the rotation amounts thereof and the time period (e.g., the predetermined time period) counted by the timer circuit of the ASIC 135.

Further, a light sensor 111 is connected to the ASIC 135. The light sensor 111 outputs an analogue electrical signal (voltage signal or current signal) in accordance with the intensity of light received by a light receiving element of the light sensor 111. The output electrical signal is input to the control unit 130. Then, the control unit 130 judges whether an electrical level (i.e., a voltage value or a current value) of the input electrical signal is not less than a predetermined value. If the electrical level of the input electrical signal is equal to or more than the predetermined value, the control unit 130 judges that the electrical level is a High level, otherwise the Low level.

The control unit 130 further judges whether the leading end of the printing sheet has reached the sheet detection unit 120 or the trailing end of the printing sheet has reached the sheet detection unit 120 based on whether the input signal is changed from the High level to the Low level, or from the Low level to the High level.

When it is judged that the leading end of the printing sheet has reached the sheet detection unit 120, the control unit 130 starts counting the rotation amounts of the pick-up motor 70 and the feed motor 71. As described above, the rotation amounts are calculated based on the pulse signals output by the rotary encoders 72 and 73. Based on the elapsed time periods from the above timing (i.e., when the leading end of the printing sheet has reached the sheet detection unit 120) and the counted rotation amount of the pick-up motor 70, the control unit 130 identifies a current location of the leading end of the printing sheet within a zone B (see FIG. 2). Further, based on the elapsed time periods from the above timing (i.e., when the leading end of the printing sheet has reached the sheet detection unit 120) and the counted rotation amount of the feed motor 71, the control unit 130 also identifies a current location of the leading end of the printing sheet within a zone C (see FIG. 2).

It should be noted that detection of the leading end of the printing sheet by the control unit 130 need not be limited to the above-described configuration. For example, the control unit 130 may identify the location of the leading end of the printing sheet based on the rotation amounts of the pick-up roller 25 and the second feed roller 62. In such a case, the rotary encoders for detecting the rotation amounts of the pick-up roller 25 and the second feed roller 62 are required. Such rotary encoders may have the same configuration as those employed in the above-described exemplary embodiment, and the encoder discs may be secured to the shafts 30 and 34 of the pick-up roller 25 and the second feed roller 34, respectively.

In the above-described exemplary embodiment, the control unit 130 starts counting the elapsed time period at a timing when the leading end of the printing sheet is detected by the detection unit 120. Alternatively, the control unit 130 starts counting the elapsed time period from a point of time when the pick-up motor 70 and the feed motor 71 are started to rotate.

As described above, the rotation speeds of the pick-up motor 70 and the feed motor 71 are calculated by the control unit 130. In a compensation control process (described later), the control unit 130 further calculates average rotation speeds of the pick-up motor 70 and the feed motor 71 within a predetermined constant speed period.

Information regarding the constant speed period is stored in the ROM 132 or the EEPROM 134. The constant speed period is included in a predetermined period that is defined as a period from the start of feeding the printing sheet (i.e., the start of driving of the pick-up motor 70) to a timing when the leading end of the printing sheet is detected by the sheet detection unit 120. That is, the predetermined period is a period during which the leading end of the printing sheet is located within a zone A (see FIG. 2) of the curved path 65A.

The constant speed period is a period, within the predetermined period, during which the pick-up motor 70 and the feed motor 71 rotate at a constant speed. The pick-up motor 70 and the feed motor 71 are accelerated from the start of driving to elapse of a predetermined time period. Thereafter, the pick-up motor 70 and the feed motor 71 are driven to rotate at a constant speed. Therefore, the start of the constant speed period is defined as a timing (which will be referred to as a first timing) at which a predetermined period has elapsed after the start of driving of the pick-up motor 70 and the feed motor 71. The end of the constant speed period is defined as a timing (which will be referred to as a second timing) when a predetermined period, during which the printing sheet is fed within the zone A, has elapsed after the start of driving of the pick-up motor 70 and the feed motor 71. In other words, the second timing is a timing when the leading end of the printing sheet is detected by the sheet detection unit 120.

The first timing can be calculated based on the specification of the pick-up motor 70 and the feed motor 71 of the MFP 10 and driving currents applied, by the control unit 130, to the pick-up motor 70 and the feed motor 71. The second timing can be calculated based on the length of the zone A and the speed of the printing sheet (i.e., the preset speed of the pick-up motor 70). As understood from the above, the constant period is a period from the first period to the second period. Thus, the information regarding the constant period (which is stored in the ROM 132 or EEPROM 134) includes time information regarding the period from the start of the pick-up motor 70 and the feed motor 71 to the first timing, and to the second timing.

The timer circuit of the control unit 130 starts counting (i.e., measuring) an elapsed time period in response to the start of driving of the pick-up motor 70. When the control unit 130 judges, based on the count of the timer circuit, that the first timing has been reached, the control unit 130 starts detecting the rotation amount of the pick-up motor 70 based on the pulse signal output by the first optical sensor and that of the feed motor 71 based on the pulse signal output by the second optical sensor.

The control unit 130 detects the rotation amounts of the pick-up motor 70 and the feed motor 71 at ever predetermined constant interval which is counted by the timer circuit. Thus, the rotation amounts of the pick-up motor 70 and the feed motor 71 are detected predetermined number of times.

The control unit 130 calculates the rotation speeds of the pick-up motor 70 and the feed motor 71 within the predetermined interval, based on the length of the predetermined interval and the rotation amounts of the pick-up motor 70 and the feed motor 71 within the predetermined interval. It is noted that the rotation speeds of the pick-up motor 70 and the feed motor 71 are calculated at every detection of the rotation amounts thereof The control unit 130 then calculates an average value of the rotation speed of the pick-up motor 70 based on the calculated values of the rotation speed of the pick-up motor 70. Further, the control unit 130 also calculates an average value of the rotation speed of the feed motor 71 based on the calculated values of the rotation speed of the feed motor 71. Then, the control unit 130 stores the calculated average speeds in the RAM 133 as rotation speeds of the pick-up motor 70 and the feed motor 71, respectively.

Next, a compensation process for compensating the rotation amount of the first feed roller 60 will be described, referring to FIG. 4.

When an instruction to start printing on a printing sheet is input to the MFP 10 from an external device or through the operation panel 17, process starts a sheet feed operation (S10). Specifically, the control unit 130 starts driving the pick-up motor 70 and the feed motor 71. As the pick-up motor 70 is driven, the pick-up roller 25 and the fourth feed roller 68 start rotating. As the pick-up roller 25 starts rotating, a printing sheet is picked up from the tray 20 and fed along the curved path 65A. As the feed motor 71 starts rotating, the first feed roller 60, the second feed roller 62 and the third feed roller 45 start rotating. Simultaneously with start of rotation of the pick-up motor 70 and the feed motor 71, the timer circuit starts counting an elapsed time.

The control unit 130 judges whether the pick-up motor 70 and the feed motor 71 rotate at a constant speed (S20). Specifically, the control unit 130 judges whether a prescribed time period has elapsed since the start of the sheet feed operation, referring to the count counted by the timer circuit (i.e., whether the first timing has been reached).

If it is judged that the pick-up motor 70 and the feed motor 71 rotate at the constant speed (S20: YES), the control unit 130 detects the rotation speeds of the pick-up motor 70 and the feed motor 71, respectively (S30).

Next, the control unit 130 judges whether the leading end of the printing sheet has reached the sheet detection unit 120 based on the output of the optical sensor 111 (S40). If the control unit 130 judges that the leading end of the printing sheet has reached the sheet detection unit 120 (S40: YES), process executes S60. If the control unit 130 judges that the leading end of the printing sheet has not yet reached the sheet detection unit 120 (S40: NO), the control unit 130 judges whether a prescribed time period has elapsed since execution of S30 (i.e., detection of the rotation speeds), referring to the counted value of the timer circuit (S50).

If the control unit 130 judges that the prescribed time period has elapsed (S50: YES), the control unit 130 detects the rotation speeds of the pick-up motor 70 and the feed motor 71 again (S30). Thus, the control unit 130 detects the rotation speeds of the pick-up motor 70 and the feed motor 71 at every prescribed time period until the leading end of the printing sheet reaches the sheet detection unit 120.

The control unit 130 calculates the average values of the rotation speeds of the pick-up motor 70 detected in steps S30-S50 (S60). This average value is regarded as the rotation speed Vp1 of the pick-up motor 70. Similarly, the control unit 130 calculates the average value of the rotation speeds of the feed motor 71 detected in steps S30-S50 (S60). This average value is regarded as the rotation speed Vp2 of the feed motor 71.

Next, the control unit 130 compares the rotation speed Vp1 with a target speed Vt1 of the pick-up motor 70 (S70). Similarly, the control unit compares the rotation speed Vp2 with a target speed Vt2 of the feed motor 71 (S70).

It is noted that the target speed Vt1 of the pick-up motor 70 has been set when the MFP 10 is designed. According to the embodiment, the target speed Vt1 itself, or a drive current value for rotating the pick-up motor 70 at the target speed Vt1 is stored in the ROM 132 or EEPROM 134. Similarly, the target speed Vt2 of the feed motor 71 has been set at the design stage, and the value itself or the corresponding current value is stored in the ROM 132 or the EEPROM 134.

As a result of comparison, if the rotation speed Vp1 and the target speed Vt1 are different, or if the rotation speed Vp2 and the target speed Vt2 are different (S70: YES), the control unit 130 execute S80. If the rotation speed Vp1 equals to the target speed Vt1, and the rotation speed Vp2 equals to the target speed Vt2 (S70: NO), the control unit 130 executes S130.

In S80, the control unit 130 calculates time t1 in accordance with an equation (1) based on the rotation speed Vp1, and a distance Lb of the zone B (see FIG. 2).

$$t1=B/Vp1 \quad (1)$$

Time t1 is a time period necessary to feed the printing sheet in the zone B when the rotation speed of the pick-up motor 70 is Vp1.

In S90, the control unit 130 calculates the rotation amount Rp of the feed motor 71 when the printing sheet is fed within the zone B in accordance with equation (2) based on time t1 calculated in S80 and the rotation speed Vp2 of the feed motor 71 calculated in S60.

$$Rp=t1\times Vp2 \quad (2)$$

In S100, the control unit 130 executes a following process. That is, the control unit 130 subtracts a target rotation amount Rt of the feed motor 71 when the printing sheet is fed within the zone B from the rotation amount Rp calculated in S90.

It is noted that the target rotation amount Rt is an amount calculated based on the target speed Vt1 of the pick-up motor 70, the target speed Vt2 of the feed motor 71, and the length Lb of the zone B. The target rotation amount Rt can be calculated in advance as described below, and the calculated value has been stored in the ROM 132 or the EEPROM 134.

Based on equation (3), a time t2 is calculated. The time t2 represents a time period necessary for feeding the printing sheet within the zone B if the pick-up motor 70 rotates at the target speed Vt1.

$$t2=B/Vt1 \quad (3)$$

Based on equation (4), the target rotation amount Rt of the feed motor 71 is calculated.

$$Rt=t2\times Vt2 \quad (4)$$

Next, the control unit 130 adds the subtracted value (Rp−Rt) to a set rotation amount Rs1 of the feed motor 71. The set rotation amount Rs1 represents the rotation amount of the feed motor 71 from a timing when the detection of the leading end of the printing sheet by the sheet detection unit 120 to a timing when the leading end of the printing sheet reaches the predetermined position 33. The set rotation amount Rs1 has been determined when the MFP 10 was designed, and is stored in the ROM 132 or EEPROM 134.

By adding the subtracted value (Rp−Rt) to the set rotation amount Rs1, a compensation rotation amount Rr1 of the feed motor 71 is obtained (see equation (5)).

$$Rr1=Rs1+(Rp-Rt) \quad (5)$$

As described above, when the actual rotation amount Rp is greater than the target rotation amount Rt, the set rotation amount Rs1 is compensated to increase, while if the actual rotation amount Rp is smaller than the target rotation amount Rt, the set rotation amount Rs1 is compensated to decrease.

Hereafter, a numerical example will be described. In the example below, the distance of zone B is 1000 (enc) where the unit "enc" represents 1/7200 (inch) which is determined based on the configuration of the encoder. The target speed Vt1 of the pick-up roller 70 is 20 (inch per second: hereinafter, referred to as ips), and the actual speed (i.e., average speed) Vp1 of the pick-up motor 70 is 15 (ips). The target speed Vt2 of the feed motor 71 is 25 (ips), and the actual speed Vp2 thereof is 20 (ips).

According to the above configuration, the time t2 is calculated using equation (3), as indicated by equation (6).

$$t2=(1000/20)\times(1/7200)\approx 0.069(\text{sec.}) \quad (6)$$

The target rotation amount Rt of the feed motor 71 is calculates using equation (4), as indicated by equation (7).

$$Rt=0.069\times 25\times 7200=12420(\text{enc}) \quad (7)$$

The time t1 is calculated using equation (1), as indicated in equation (8).

$$t1=(10000/15)\times(1/7200)\approx 0.0925(\text{sec.}) \quad (8)$$

The actual rotation amount Rp of the feed motor 71 is calculated using equation (2), as indicated in equation (9).

$$Rp=0.0925\times 20\times 7200=13320(\text{enc}) \quad (9)$$

Then, the control unit 130 compensates for the set rotation amount Rs1 by the amount (Rp−Rt). That is, the amount of compensation is calculated such that 13320−12420=900 (enc) (see equation (5)). With this compensation process, the compensation amount Rr1 is obtained.

It is noted that the rotation amount of the first feed roller 60 is determined in accordance with the rotation amount of the feed motor 71. For example, the rotation amount of the first feed roller 60 is determined in accordance with a gear ratio of the first feed roller 60 with respect to the feed motor 71. Therefore, the set rotation amount Rs2 of the first feed roller 60 from a timing when the leading end of the printing sheet is detected by the sheet detection unit 120 to a timing when the leading end of the printing sheet reaches the predetermined position 33 is set in advance, corresponding to the set rotation amount Rs1 of the feed motor 71, and is stored in the ROM 132 or the EEPROM 134. Further, the compensation rotation amount Rr2 of the first feed roller 60 is determined corresponding to the compensation rotation amount Rr1 of the feed motor 71. The above process is executed by the control unit 130 in S100.

The set rotation amounts Rs1 and Rs2 are, as described above, stored in the ROM 132 or the EEPROM 134. In S100, process retrieves the above amounts from the ROM 132 or the EEPROM 134 and stores the same in a rotation amount storing area defined in the RAM 133. Thereafter, compensation is applied to the set rotation amounts Rs1 and Rs2 stored in the rotation amount storing area of the RAM 133. If the compensation has been applied, the rotations amounts Rs1 and Rs2 before the compensation (stored in the rotation amount storing area of the RAM 133) are replaced with compensation rotation amounts Rr1 and Rr2, respectively.

After calculating the compensation rotation amount Rr2, the control unit 130 sets a fourth rotation amount R4 (S10). The fourth rotation amount R4 is a rotation amount corresponding to the rotation speed of the pick-up motor 70 during a predetermined time period. For example, the control unit 130 sets the fourth rotation amount R4 by referring to a data table (see FIG. 6) stored in the ROM 132 or the EEPROM 134.

As shown in FIG. 6, in first to third rows of the data table, a relationship among a plurality of feeding speeds (in first row), rotation amounts corresponding to respective feeding speeds (in second row) and compensation amounts as the fourth rotation amounts R4 corresponding to respective feeding speeds (in third row) are indicated.

As shown in FIG. 6, according to the embodiment, the feeding speed is categorized in five steps corresponding to quality of an image printed on the printing sheet. Specifically, for the higher quality image, the feeding speed is set to slower.

Each of the rotation amounts indicated in the second row represents a rotation amount within a period from a timing when the leading end of the printing sheet is detected by the sheet detection unit 120 to a timing when the leading end of the printing sheet reaches the nip between the first feed roller 60 and the pinch roller 61 within the set rotation amount Rs2 of the first feed roller 60. For example, if a user selects, via the operation panel 17, a mode in which the sheet feed speed is 25 (ips), the control unit 130 sets 400 as the fourth rotation amount R4. The set fourth rotation amount R4 is stored in the RAM 133.

According to the embodiment, the feeding speed is selected based on the image quality mode. However, the feed speed may be set based on the rotation speed Vp1 of the pick-up motor 70 calculated by the control unit 130 in S60. In such a case, the data table may be modified such that the feeding speed is categorized in smaller interval and more number of steps.

After setting the fourth rotation amount R4, the control unit 130 sets a fifth rotation amount R5 (S120). The fifth rotation amount R5 is a rotation amount which is set corresponding to type information representing a type of the printing sheet fed along the feeding path 65.

For example, the control unit 130 determines the fifth rotation amount R5 by referring to the data table shown in FIG. 6. The data table includes, in addition to the second and third rows for normal printing sheet as described above, fourth and fifth rows for glossy printing sheet. Specifically, the rotation amounts for the glossy printing sheets are indicated in the fourth row, and the compensation amounts (i.e., the fifth rotation amount R5) are indicated in the fifth row.

For example, if the MFP 10 is provided with two sheet trays 20, (e.g., the normal printing sheets are placed in one sheet tray 20 and the glossy printing sheets are placed on the other sheet tray 20), the user can select one of the two sheet trays 20 via the operation panel 17, that is, the user can select the type of the printing sheets to be fed. If the user selects the glossy printing sheet and sheet feed speed of 25 (ips) via the operation panel 17, value "440" is set by the control unit 130 as the fifth rotation amount R5. Thus set value 440 representing the rotation amount is stored in the RAM 133.

As above, according to the embodiment, the fourth rotation amount R4 is set in accordance with the sheet feed speed, and the fifth rotation amount R5 is set in accordance with the type information of the printing sheet. It is noted that, according to the embodiment, the fourth rotation amount R4 and the fifth rotation amount R5 are set as a single rotation amount. It is noted that, by providing data tables for the rotation amount R4 and R5 separately, the fourth rotation amount R4 and the fifth rotation amount R5 may be set separately.

After setting the fifth rotation amount R5, the control unit 130 adds the fourth rotation amount R4 set in S130 and the fifth rotation amount R5 set in S140 (S150). For example, the fourth rotation amount R4 stored in the RAM 133 and a value "440" as the value of the fifth rotation amount R5 are added to the compensation rotation amount Rr2. Then, the compensation rotation amount Re2 thus calculated replaces previous compensation rotation amount Rr2 before the above-described addition is done, and stored in the rotation amount storing area.

The control unit 130 rotates the first feed roller 60 by the amount obtained in S130. During the rotation of the first feed roller 60, the printing sheet fed by the pick-up roller 25 reaches the nip between the first feed roller 60 and the pinch roller 61. Thereafter, the printing sheet is fed by the first feed roller 60. It is noted that the first feed roller 60 keeps feeding the printing sheet until it stops rotating after rotating by the amount obtained in S130 (S140). When the first feed roller 60 stops rotating, that is, when the sheet feed operation is terminated (S140), the leading end of the printing sheet is located at the predetermined position 33.

It is noted that the pick-up motor 70 stops rotating after it rotates by a predetermined rotation amount. This amount is set in advance such that the print sheet reaches the nip between the first feed roller 60 and the pinch roller 61 without fail. It is also noted that when the sheet feed operation is terminated, the timer circuit is reset.

At this state, an image formation on the printing sheet is started. Specifically, the control unit 130 starts reciprocating the print unit 24 in the right and left direction 9, and intermittently feeds the printing sheet in the sheet feed direction. The printing unit 24 ejects ink drops with moving in the right and left direction 9 when the printing sheet is stopped. As above, an image is printed on the printing sheet (S150).

When printing of the image on the printing sheet is finished, the control unit 130 judges whether the duplex printing mode is currently selected in S160. It is noted that selection of the simplex mode or the duplex mode is done by the user via the operation panel 17.

If the simplex mode is currently selected (S160: NO), the printing sheet is ejected to the ejected sheet holding unit 79, and the compensation control process is finished.

If the duplex mode is currently selected (S160: YES), the printing sheet is switched back and introduced to the reverse feed path 67. Then, at a certain timing which is later than a timing at which the leading end of the printing sheet reaches the nip between the fourth feed roller 68 and the driven roller 69, the pick-up motor 70 is driven again and the sheet pick-up operation is started (S10). The printing sheet is fed, by the fourth feed roller 68, along the reverse feed path 67 to the converging position 37. Thereafter, the printing sheet is fed, along the feed path 65, with its front surface/back surface reversed in comparison with a case when the printing sheet is fed in S10-S15 described above. Then, S20-S160 are executed again. At this time, zone D is used instead of zone A. It is noted that zone D is defined as a zone from the nip between the fourth feed roller 68 and the driven roller 69 to the sheet detection position by the sheet detection unit 120. After an image is printed on the back surface of the printing sheet (S150, S160: NO), the printing sheet is ejected to the ejected sheet holding unit 79, and the compensation process is terminated.

According to the embodiment, as indicated in the numerical example, the speed of the feed motor 71 is faster than the speed of the pick-up motor 70. The reason is as follows. If one printing sheet is fed, or if the duplex printing is performed, the pick-up motor 70 is stopped after rotated by a predetermined amount. If the simplex printing is executed and more than one printing sheets are fed consequently, the pick-up motor 70 is continuously rotated for a high-speed performance. However, the feed motor 71 is driven to rotate intermittently as described above when an image is being printed on the printing sheet. Therefore, a subsequently fed printing sheet may forereach a previously fed printing sheet. According to the embodiment, to avoid such a situation, the speed of the sheet feed motor 71 is set to be faster than the speed of the pick-up motor 70. With this configuration, forereaching of subsequently fed printing sheet can be avoided, and an appropriate interval can be provided between a previously fed printing sheet and a subsequently fed one.

If there is a difference between the rotation speed of the pick-up motor 70 and its target speed, or if there is a difference between the rotation speed of the feed motor 71 and its target speed, the timing at which the printing sheet is started to be fed by the first feed roller 60 may become earlier or later. If the first feed roller 60 is driven to rotate by a predetermined amount regardless of the timing at which the printing sheet is started to be fed, a position at which the printing sheet is located when the feeding by the first feed roller 60 is stopped is deviated with respect to the predetermined position 33. According to the embodiment, the control unit 130 compensates the set rotation amount Rs2 based on the rotation speeds of the pick-up motor 70 and the feed motor 71 during a predetermined period. Therefore, the deviation of the stopped location of the printing sheet with respect to the predetermined position 33 due to the variation of the timing described above can be prevented. Therefore, according to the embodiment, even if the rotation speeds of the pick-up roller 25 and/or the first feed roller 60 include an error with respect to their target speeds, it is possible to stop the printing sheet at the predetermined target position 33.

When the printing sheet is fed from a position when the pick-up roller 25 is started to be driven to a position at which the printing sheet is detected by the sheet detection unit 120, the pick-up roller 25 may slip with respect to the printing sheet. If such a phenomenon occurs, the rotation amount of the sheet feed roller 25 increases but the fed amount of the printing sheet by the pick-up roller 25 does not increase. According to the embodiment, a fourth rotation amount R4 is set corresponding to the rotation speed of the pick-up roller 25. Then, the control unit 130 adds the fourth rotation amount R4, which corresponds to the rotation amount of the pick-up roller 25 within a predetermined period, to the compensation rotation amount Rr2. With this configuration, shortage of the feeding distance of the printing sheet by the pick-up roller 25 due to the slip of the pick-up roller 25 with respect to the printing sheet can be compensated by increasing the feeding amount of the printing sheet by the first feed roller 60.

For example, the pick-up roller 25 tends to slip more when the printing sheet being fed is a glossy sheet in comparison with a normal sheet. According to the embodiment, a fifth rotation amount R5 is set for each type of printing sheet. The control unit 130 adds the fifth rotation amount R5 to the compensation rotation amount Rr2. With this configuration, effects of slipping amount which varies depending on the type of the printing sheet can be suppressed.

According to the embodiment, the MFP 10 is configured to execute the duplex printing. Therefore, the MFP 10 is provided with the reverse feed path 67 and the fourth feed roller 68. Since the fourth feed roller 68 is driven by the pick-up motor 70, the effects similar to the above can be achieved.

According to the embodiment, the speed detection unit includes the first rotary encoder 72, the second rotary encoder 73 and the timer circuit. With this configuration, the speed detection unit is capable of detecting the speed of the pick-up motor 70 and the feed motor 71 correctly.

Further, according to the embodiment, the speed detection unit is configured such that the rotation speeds of the pick-up motor 70 and the feed motor 71 a plurality of times within a zone where the printing sheet is fed at a constant speed, and average values are calculated. Therefore, the speed detection unit is capable of obtaining the rotation speeds which are more reliable in comparison with a case where the speed is detected at a single position.

First Modification

In the above-described embodiment, the control unit 130 compensates the set rotation amount Rs2 which is preliminarily set as the rotation amount of the first feed roller 60 in the compensation control process. This configuration may be modified such that the control unit 130 compensates at least one of the rotation speeds of the pick-up motor 70 and the feed motor 71. Such a modification will be described referring to FIG. 5. It is noted that the steps similar to those in FIG. 4 are indicated by the same step numbers (S10-S60, and S110-S160) and descriptions thereof are omitted for brevity.

Figure 4:
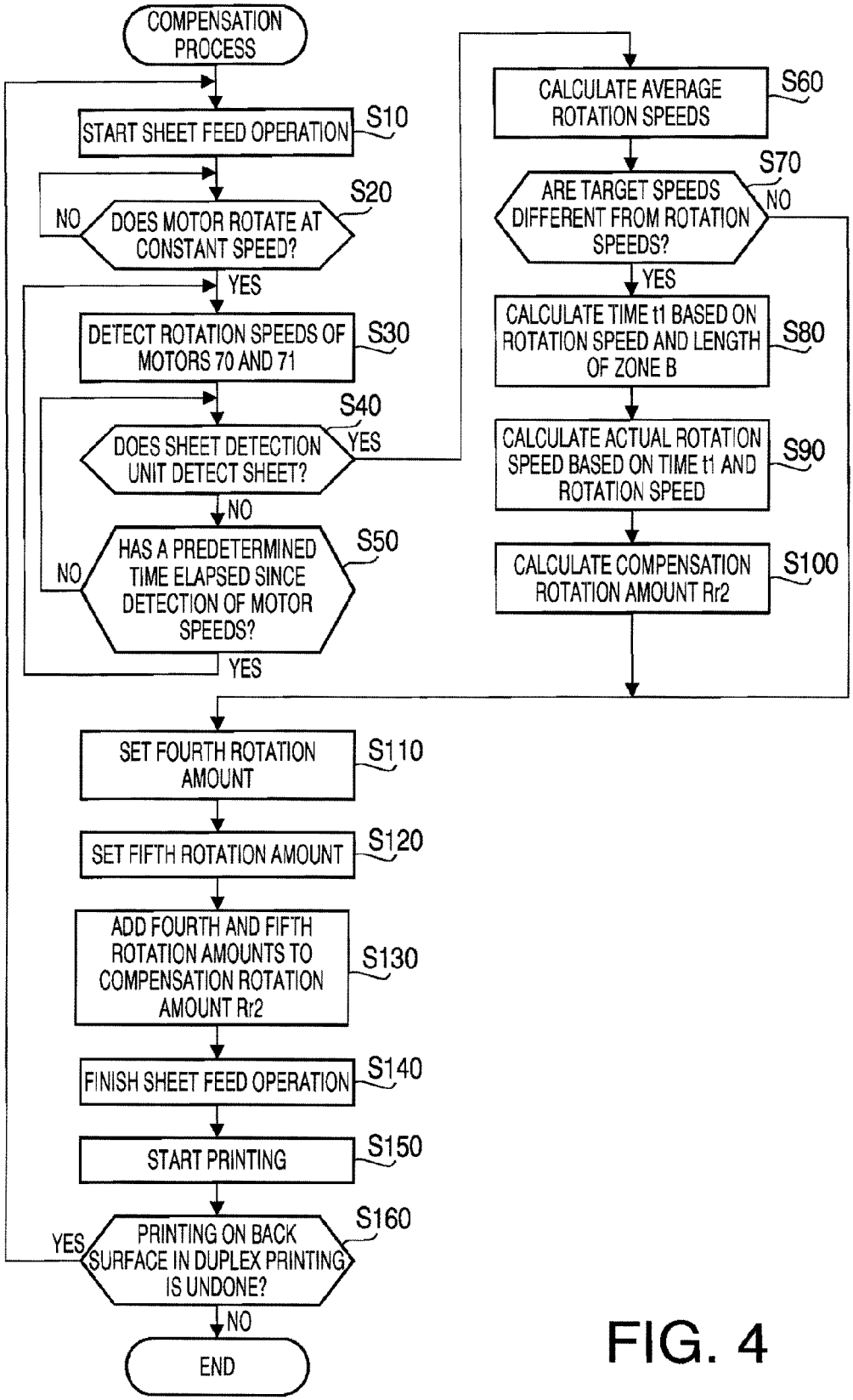
FIG. 4 is a flowchart illustrating a compensation process according to the embodiment of the invention.
Figure 5:
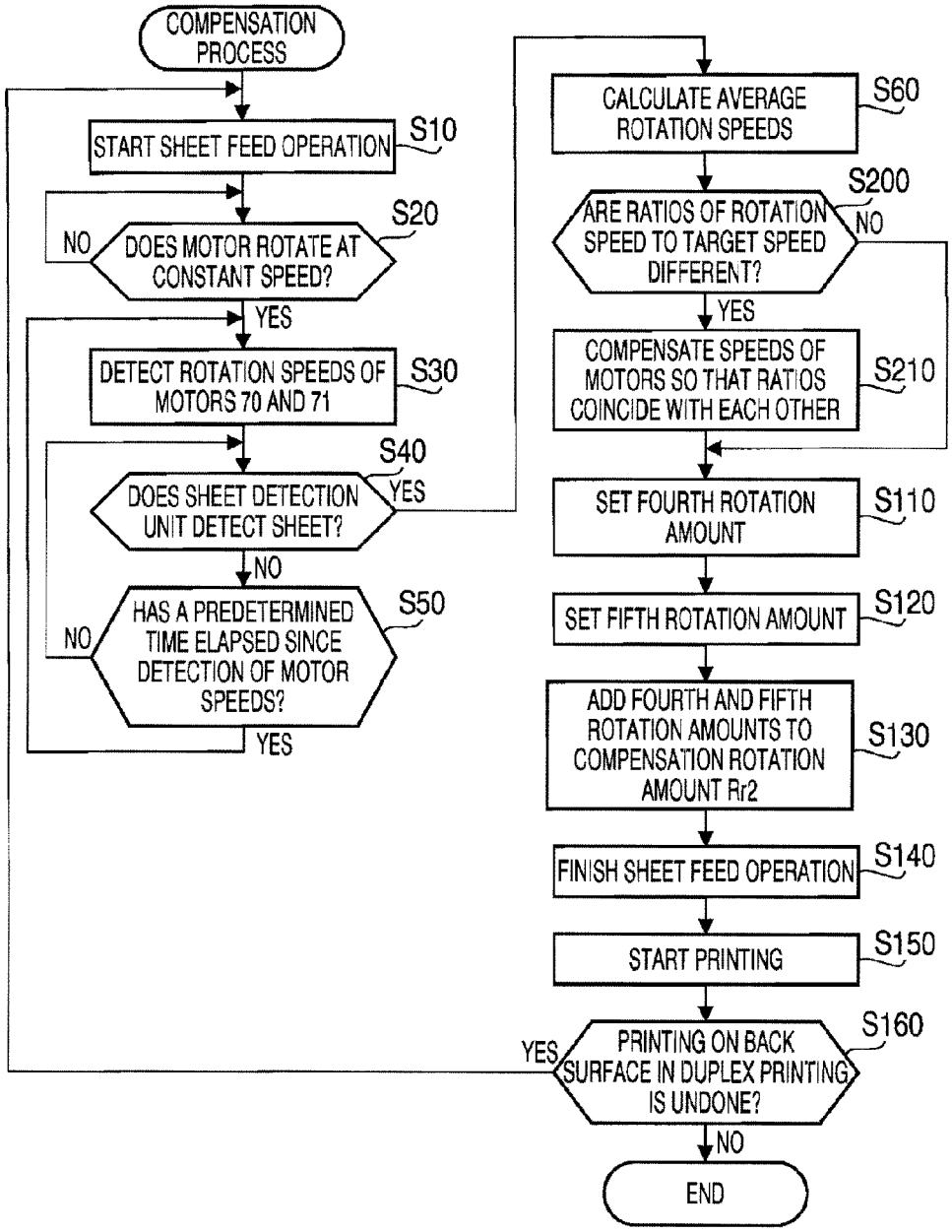
FIG. 5 is a flowchart illustrating a compensation process according to a first modification of the embodiment of the invention.

In the first modification, steps S70-S100 of FIG. 4 are replaced with steps S200 and S210. Further, S130 is slightly changed. That is, in the above-described embodiment, in S130, the fourth rotation amount R4 or the fifth rotation amount R5 is added to the compensation rotation amount Rr2. In the first modification, in S130, the fourth rotation amount R4 or the fifth rotation amount R5 is added to the set rotation amount Rs2.

In S200, the control unit 130 calculates a first speed ratio of the rotation speed Vp1 of the pick-up motor 70 to the rotation speed Vp2 of the feed motor 71 which are calculated in S60. Further, in S200, the control unit 130 calculates second speed ratio of the target speed Vt1 of the pick-up motor 70 to the target speed Vt2 of the feed motor 70. Then, the control unit 130 compares the first speed ratio with the second speed ratio.

If the first speed ratio and the second speed ratio are different (S200: YES), the control unit 130 executes S210. If the first speed ratio and the second speed ratio are the same (S200: NO), the control unit 130 executes S110.

In S210, the control unit 130 compensates at least one of the rotation speeds of the pick-up motor 70 and the feed motor 71 to make the first speed ratio and the second speed ratio coincide with each other.

For example, the control nit 130 decreases the faster one of the rotation speeds of the pick-up motor 70 and the feed motor 71 to make the first and second speed ratios coincide with each other. Specifically, the control unit 130 decreases the electrical current flowing through the drive circuit of the ASIC 135 so that the faster one of the rotation speeds of the pick-up motor 70 and the feed motor 71 to the other of the rotation speeds of the pick-up motor 70 and the feed motor 71.

Hereafter, numerical examples by the fifth compensation unit will be described. In a first example, a case where one of the rotation speeds of the pick-up motor 70 and the feed motor 71 is decreased will be explained. In a second example, a case where both the rotation speeds of the pick-up motor 70 and the feed motor 71 are decreased will be explained.

In the first example, the speed Vp1 of the pick-up motor 70 is assumed to be 18 (ips), while the speed Vp2 of the feed motor 71 is assumed to be 20 (ips). The target speed Vt1 of the pick-up motor 70 is 20 (ips), while the target speed Vt2 of the feed motor 71 is 25 (ips).

In the above example, the first speed ratio is Vp1/Vp2=18/20=9/10, and the second speed ratio is Vt1/Vt2=20/25=4/5. In this example, the control unit 130 decreases the rotation speed Vp1 of the pick-up motor 70 from 18 (ips) to 16 (ips). With this change, the first speed ratio is Vp1/Vp2=16/20=4/5 which coincides with the second speed ratio.

In the second example, the speed Vp1 of the pick-up motor 70 is assumed to be 18 (ips), while the speed Vp2 of the feed motor 71 is assumed to be 23 (ips). The target speed Vt1 of the pick-up motor 70 is 20 (ips), while the target speed Vt2 of the feed motor 71 is 25 (ips).

In the second example, the first speed ratio is Vp1/Vp2=18/23, and the second speed ratio is Vt1/Vt2=20/25=4/5. In this example, the control unit 130 decreases the rotation speed Vp1 of the pick-up motor 70 from 18 (ips) to 16 (ips), and the rotation speed Vp2 of the feed motor 71 from 23 (ips) to 20 (ips). With this change, the first speed ratio is Vp1/Vp2=16/20=4/5 which coincides with the second speed ratio.

The control unit 130 rotates the first feed roller 60 by the rotation amount that is obtained in S130 (i.e., the set rotation amount Rs2 plus the fourth rotation amount R4 and the fifth rotation amount R5). It is noted that steps S110-S130 are optional steps. If S110-S130 have not been executed, the control unit 130 rotates the first feed roller 60 only by the set amount Rs2. The first feed roller 60 feeds the printing sheet until the rotation thereof is stopped (S140).

Similar to the exemplary embodiment, the feed motor 71 is configured such that the rotation speed thereof is faster than the rotation speed of the pick-up motor 70. The reason is, as described above, to provide an appropriate interval between two subsequent printing sheets.

If the speed ratio of the actual rotation speeds is different from the speed ratio of the target speeds, if feeding of the printing sheet is executed based on the predetermined amount, a timing at which the printing sheet reaches the first feed roller 60 may vary. According to the first modification, the control unit 130 make the first speed ratio (i.e., the ratio of the rotation speed of the pick-up motor 70 to the rotation speed of the feed motor 71) coincide with second speed ratio (i.e., the ratio of the target rotation speed of the pick-up motor 70 to the target rotation speed of the feed motor 71) on condition that the leading end of the printing sheet is detected by the detection unit 120.

According to the first modification, when the printing sheet is fed on the downstream side with respect to the detection unit 120, the first speed ratio coincides with the second speed ratio. Therefore, it is possible to suppress a condition that the timing at which the printing sheet reaches the first feed roller 60 is shifted due to the difference between the first speed ratio and the second speed ratio.

Second Modification

In the exemplary embodiment and the first modification, the control unit 130 sets the fourth rotation amount R4 which is a compensation amount corresponding to the sheet feed speed within a predetermined period (i.e., the rotation speed Vp1 of the pick-up motor 70 calculated in S60). According to the second modification, the control unit 130 sets a third rotation amount R3 which is a compensation amount corresponding to the rotation amount of the pick-up roller 25 within the predetermined period.

Hereinafter, a compensation process according to the second modification will be described in detail with reference to a flowchart shown in FIG. 7. It is noted that, according to the second modification, steps S300 and S310 are newly introduced instead of S110 and S130 of FIG. 4, and the other steps shown in FIG. 7 are similar to those in FIG. 4. Therefore, only S300 and S310 will be described below for brevity. According to the second modification, the process shown in FIG. 5 can also be modified by replacing S110 and S130 with S300 and S310, respectively, but description thereof is omitted for brevity.

In S300, the control unit 130 obtains the third rotation amount R3, for example, by referring to a data table stored in the ROM 132 or the EEPROM 134. It is noted that the data table according to the second modification is different from the data table of the exemplary embodiment or the first modification as shown in FIG. 6.

Specifically, according to the second modification, the data table is configured such that a first row indicates a plurality of rotation amounts of the pick-up roller 25, but not the sheet feed speeds. Further, a third row of the data table indicates a plurality of third rotation amounts R3 respectively corresponding to the plurality of rotation amounts of the pick-up roller 25 indicated in the first row.

According to the second modification, the control unit 130 detects the rotation amount of the pick-up roller 25 when the leading end of the printing sheet is detected by the sheet detection unit 120. For this purpose, the MFP 10 according to the second modification needs to have an encoder for detecting the rotation amount of the pick-up roller 25. The encoder may have a well-know structure. For example, the encoder according to the second modification may be similar to the first rotary encoder 72 employed in the exemplary embodiment.

The control unit 130 detects the rotation amount of the pick-up roller 25, and refers to the data table to obtain the third rotation amount R3 corresponding to the detected rotation amount of the pick-up roller 25.

Then, the control unit 130 adds the third rotation amount R3 obtained in S300 and the fifth rotation amount R5 obtained in S120 to the compensation rotation amount Rr2 (S310).

In the above-described second modification, the speed of the feed motor 71 is set to be faster than the speed of the pick-up motor 70. The reason is the same as in the above-described embodiment and the first modification. That is, the speeds are differentiated so that an appropriate interval is formed between the previously fed sheet and the subsequently fed sheet if the two printing sheets are sequentially and continuously fed as the simplex printing is executed.

When the printing sheet is fed from a position, which is the position of the printing sheet when the pick-up roller 25 starts rotating, to a position, at which the printing sheet is detected by the sheet detection unit 120, the pick-up roller 25 may slip with respect to the printing sheet. In such a case, although the rotation amount of the pick-up roller increases, a fed amount of the printing sheet does not increase. According to the second modification, to deal with such a problem, a third rotation amount R3 is set corresponding to the rotation amount of the pick-up roller 25 within a predetermined period. Then, the control unit 130 adds the third rotation amount R3 corresponding to the rotation amount of the pick-up roller 25 within the predetermined period to the set rotation amount Rs2 or the compensation rotation amount Rr2. With this configuration, shortage of the feeding amount of the printing sheet due to slip of the pick-up roller 25 with respect to the printing sheet can be compensated by increasing the feeding amount by the first feed roller 60.

Third Modification

In the above-described exemplary embodiment, the control unit 130 detects the rotation speed of the pick-up motor 70 and the feed motor 71 within a constant speed period by a plurality of times (FIG. 4, S30-S50), and calculates averages thereof (FIG. 4, S60) in the compensation control process. It may be possible to modify the above configuration such that the rotation speeds of the pick-up motor 70 and the feed motor 71 only by once.

In such a modification (i.e., the third modification), the control unit 130 detects the rotation speeds of the pick-up motor 70 and the feed motor 71 (S30) only by once. The detected rotation speeds of the pick-up motor and the feed motor 71 are used as actual rotation speeds Vp1 and Vp2, respectively. In this modification, steps S40-S60 are omitted. Then, in S70, the control unit 130 compares the actual speed Vp1 of the pick-up motor 70 with the target speed Vt1 of the pick-up motor 70 (S70). Similarly, the control unit compares the actual speed Vp2 of the feed motor 71 with the target speed Vt2 of the feed motor 71 (S70).

It is noted that, also in the above-described third modifications, the speed of the feed motor 71 is set faster than the speed of the pick-up motor 70 for the same reason (i.e., the speeds are differentiated so that an appropriate interval is formed between the previously fed sheet and the subsequently fed sheet if the two printing sheets are sequentially and continuously fed as the simplex printing is executed).

What is claimed is:

1. A sheet feeding device, comprising:

a first roller configured to feed a sheet in a first direction along a first feed path;

a first motor configured to drive the first roller to rotate;

a second roller arranged on a downstream side, in the first direction, of the first roller and configured to feed the sheet in the first direction along the first feed path;

a second motor configured to drive the second roller to rotate;

a sheet detection unit arranged, in the first feed path, between the first roller and the second roller, and configured to detect a leading end of the sheet fed in the first direction;

a speed detection unit configured to detect a rotation speed of the first motor and a rotation speed of the second motor;

a judging unit configured to judge whether the rotation speeds of the first motor and the second motor detected by the speed detection unit are equal to target rotation speeds of the first motor and the second motor, respectively; and a first compensation unit configured to set a second rotation amount by compensating a first rotation amount that is set preliminarily as a rotation amount of the second roller for feeding the sheet, from detection of the leading end of the sheet by the sheet detection unit, to arrival of the sheet at a predetermined position on the downstream side, in the first direction, of the second roller, based on the rotation speed of the first motor within a first period, which is a period from start of feeding of the sheet as the first roller is started to be driven to the detection of the leading end of the sheet by the sheet detection unit, on condition that the leading end of the sheet is detected by the sheet detection unit, if the judging unit judges that at least one of (a) the rotation speed of the first motor detected by the speed detection unit is not equal to the target rotation speed of the first motor and (b) the rotation speed of the second motor detected by the speed detection unit is not equal to the target rotation speed of the second motor;

wherein, after setting the second rotation amount, the second motor drives the second roller based on the second rotation amount so as to feed the leading end of the sheet to the predetermined position.

2. The sheet feeding device according to claim 1, further comprising a second compensation unit configured to add a third rotation amount, which is set corresponding to the rotation speed of the first motor within the first period, to the second rotation amount.

3. The sheet feeding device according to claim 1, further comprising a second compensation unit configured to add a third rotation amount, which is set corresponding to type information indicative of a type of the sheet fed along the first feed path, to the second rotation amount.

4. The sheet feeding device according to claim 1, further including:

a second feed path diverging from the first feed path at a diverging position which is a position on the downstream side, in the first direction, of the predetermined position, and converging to the first feed path at a converging position, which is a position on an upstream side, in the first direction, of the sheet detection unit, the second feed path guiding the sheet in a second feed direction from the diverging position to the converging position; and a third roller provided in the second feed path, the third roller being driven by the first motor to feed the sheet in the second direction along the second feed path.

5. The sheet feeding device according to claim 1, wherein the speed detection unit includes:

a first encoder configured to detect the rotation amount of the first motor;

a second encoder configured to detect the rotation amount of the second motor; and a counter configured to measure an elapsed time, wherein the speed detection unit calculates the speed of the first motor based on a time period measured by the counter and the rotation amount of the first motor corresponding to the time period, and the speed of the second motor based on the time period measured by the counter and the rotation amount of the second motor corresponding to the time period.

6. The sheet feeding device according to claim 1, wherein the speed detection unit detects the rotation speed of the first motor by a plurality of times to obtain a plurality of rotation speeds of the first motor within a second period which is preliminarily defined as a period in which each of the first and second motors stably rotates at a constant speed, and calculates an average rotation speed of the first motor by averaging the plurality of rotation speeds, obtained within the second period, of the first motor, and wherein the speed detection unit also detects the rotation speed of the second motor by a plurality of times to obtain a plurality of rotation speeds of the second motor within the second period, and calculates an average rotation speed of the second motor by averaging the plurality of rotation speeds, obtained within the second period, of the second motor.

7. A sheet feeding device, comprising:

a first roller configured to feed a sheet in a first direction along a first feed path;

a first motor configured to drive the first roller to rotate;

a second roller arranged on a downstream side, in the first direction, of the first roller and configured to feed the sheet in the first direction along the first feed path;

a second motor configured to drive the second roller to rotate;

a sheet detection unit arranged, in the first feed path, between the first roller and the second roller, and configured to detect a leading end of the sheet fed in the first direction;

a speed detection unit configured to detect a rotation speed of the first motor and a rotation speed of the second motor;

a judging unit configured to judge whether the rotation speeds of the first motor and the second motor detected by the speed detection unit are equal to target rotation speeds of the first motor and the second motor, respectively;

a first compensation unit configured to set a second rotation amount by compensating a first rotation amount that is set preliminarily as a rotation amount of the second roller for feeding the sheet, from detection of the leading end of the sheet by the sheet detection unit, to arrival of the sheet at a predetermined position on the downstream side, in the first direction, of the second roller, based on the rotation speed of the first motor within a first period, which is a period from start of feeding of the sheet as the first roller is started to be driven to the detection of the leading end of the sheet by the sheet detection unit, on condition that the leading end of the sheet is detected by the sheet detection unit, if the judging unit judges that at least one of (a) the rotation speed of the first motor detected by the speed detection unit is not equal to the target rotation speed of the first motor and (b) the rotation speed of the second motor detected by the speed detection unit is not equal to the target rotation speed of the second motor; and a second compensation unit configured to add a third rotation amount, which is set corresponding to the rotation amount of the first roller within the first period, to the second rotation amount.

8. A sheet feeding device, comprising:

a first roller configured to feed a sheet in a first direction along a first feed path;

a first motor configured to drive the first roller to rotate;

a second roller arranged on a downstream side, in the first direction, of the first roller and configured to feed the sheet in the first direction along the first feed path;

a second motor configured to drive the second roller to rotate;

a sheet detection unit arranged, in the first feed path, between the first roller and the second roller, and configured to detect a leading end of the sheet fed in the first direction;

a speed detection unit configured to detect a rotation speed of the first motor and a rotation speed of the second motor;

a judging unit configured to judge whether a ratio of the rotation speed of the first motor to the rotation speed the second motor is equal to a ratio of a target speed of the first motor to a target speed of the second motor;

a first compensation unit configured to compensate at least one of the rotation speed of the first motor and the rotation speed of the second motor so that the ratio of the rotation speed of the first motor to the rotation speed of the second motor coincides with the ratio of a target speed of the first motor to a target speed of the second motor based on the ratio of the rotation speed of the first motor to the rotation speed of the second motor within a first period from start of feeding of the sheet as the first roller is started to be driven to the detection of the leading end of the sheet by the sheet detection unit on condition that the leading end of the sheet is detected by the sheet detection unit, if the judging unit judges that the ratio of the rotation speed of the first motor to the rotation speed of the second motor does not coincide with the ratio of the target speed of the first motor to the target speed of the second motor; and a control unit which controls the second roller to rotate by a first rotation amount which is preliminarily set as a rotation amount of the second roller for feeding the sheet, from detection of the leading end of the sheet by the detection unit, to a predetermined position on the downstream side, in the first direction, of the second roller, on condition that the leading end of the sheet is detected by the sheet detection unit.

9. The sheet feeding device according to claim 8, further comprising a second compensation unit configured to add a third rotation amount which is set corresponding to the rotation amount of the first roller during the first period to the first rotation amount on condition that the leading end of the sheet is detected by the sheet detection unit.

10. The sheet feeding device according to claim 8, further comprising a second compensation unit configured to add a third rotation amount which is set corresponding to the rotation speed of the first roller during the first period to the first rotation amount on condition that the leading end of the sheet is detected by the sheet detection unit.

11. The sheet feeding device according to claim 8, further comprising a second compensation unit configured to add a third rotation amount which is set corresponding to type information indicative of a type of the sheet fed in the first feed path to the first rotation amount on condition that the leading end of the sheet is detected by the sheet detection unit.

12. The sheet feeding device according to claim 8, further including:

a second feed path diverging from the first feed path at a diverging position which is a position on the downstream side, in the first direction, of the predetermined position, and converging to the first feed path at a converging position, which is a position on an upstream side, in the first direction, of the sheet detection unit, the second feed path guiding the sheet in a second feed direction from the diverging position to the converging position; and a third roller provided in the second feed path, the third roller being driven by the first motor to feed the sheet in the second direction along the second feed path.

13. The sheet feeding device according to claim 8, wherein the speed detection unit includes:

a first encoder configured to detect the rotation amount of the first motor;

a second encoder configured to detect the rotation amount of the second motor; and a counter configured to measure an elapsed time, and wherein the speed detection unit calculates the speed of the first motor based on a time period measured by the counter and the rotation amount of the first motor corresponding to the time period, and the speed of the second motor based on the time period measured by the counter and the rotation amount of the second motor corresponding to the time period.

14. The sheet feeding device according to claim 8, wherein the speed detection unit detects the rotation speed of the first motor by a plurality of times to obtain a plurality of rotation speeds of the first motor within a second period which is preliminarily defined as a period in which each of the first and second motors stably rotates at a constant speed, and calculates an average rotation speed of the first motor by averaging the plurality of rotation speeds, obtained within the second period, of the first motor, and wherein the speed detection unit also detects the rotation speed of the second motor by a plurality of times to obtain a plurality of rotation speeds of the second motor within the second period, and calculates an average rotation speed of the second motor by averaging the plurality of rotation speeds, obtained within the second period, of the second motor.

* * * * *